US007786365B1

(12) United States Patent
Bader

(10) Patent No.: US 7,786,365 B1
(45) Date of Patent: Aug. 31, 2010

(54) SOUND SHOE

(75) Inventor: Rohan Bader, 2 Waterwheel Street, Markham, Ontario (CA) L3P 6M5

(73) Assignee: Rohan Bader, Markham, ON (CA)

( * ) Notice: Subject to any disclaimer, the term of this patent is extended or adjusted under 35 U.S.C. 154(b) by 0 days.

(21) Appl. No.: 12/536,458

(22) Filed: Aug. 5, 2009

(51) Int. Cl.
*G10D 13/04* (2006.01)

(52) U.S. Cl. ..... 84/418

(58) Field of Classification Search ..... 84/411 R, 84/418, 421
See application file for complete search history.

(56) References Cited

U.S. PATENT DOCUMENTS

2008/0087158 A1* 4/2008 Payerl ..... 84/402

* cited by examiner

*Primary Examiner*—Kimberly R Lockett
(74) *Attorney, Agent, or Firm*—Nasser Ashgriz

(57) ABSTRACT

The present invention relates to the foot operated musical instruments like tambourine, cymbals, jingles and cowbells. These musical instruments can be operated by using one or both feet at the same time. The tambourine playing shoes can be converted to a percussion shoe very easily. The foot operated instruments of the present invention lets musicians to play multiple instruments at the same time, while giving a new found sound to a musician's tapping foot.

12 Claims, 9 Drawing Sheets

SOUND SHOE

FIELD OF THE INVENTION

The present invention relates to the foot operated musical instruments like tambourines, cymbals, jingles, shakers and cowbells. These feet operated instruments like present invention help the musician play multiple instruments at the same time by simply tapping their feet. The easily changeable sounds of the present invention gives the musician a vast choice of foot-operated percussion sounds that they can easily attach or detach to their foot.

BACKGROUND OF THE INVENTION

The present invention relates to foot operated musical devices and more particularly to a novel method of operation of tambourine, guiro, cymbals and cowbells with feet. The use of foot operated musical instruments are well known in the prior art. For example, U.S. Pat. No. 6,096,957 issued to Matt Anderson discloses a foot operated playing device, where tambourine is mounted onto a foot pedal coupled with a base pad. Although this device can be played by foot; there are chances that while playing the device the foot may slip from the instrument, because there is no connection between the foot and the device.

U.S. Pat. No. 3,481,239 issued to L. Blumenfled discloses a tambourine jingle rim supporting and actuating mechanism. This instrument can be played by tapping with foot at the base of the longitudinally mounted tambourine jingle rim. Although this device has advantage of axial movement and limited secondary movement, its main draw back is that it is operated by an extra pedal and is not secured onto the feet firmly. Because of the pedal tapping by the toe end of the foot, and because of the intense movement, there may be strain and pain in the calf muscles of the leg after certain period of operation.

U.S. Pat. No. 3,994,197 issued to John Bills, discloses a tambourine that is connected onto a foot pedal and strike the leg of the operator near calf muscles above the operator's foot operating the foot pedal. If the operator strikes the pedal hard it may injure the calf muscles of the operator.

U.S. Publication No. 2005/0028601 discloses a foot operated tambourine playing device for playing with left or right foot. This device can be fixed onto the toe end of the user's feet. The main drawback of this invention is that it is made of metal and is heavy.

U.S. Publication No. 2009/0087158 A1 by wolfgang Payerl discloses a musical rhythm instrument with sounding devices where the instrument is fastened to the user's feet. The main disadvantage of this invention is that it requires extra strings for attaching to the users feet and may be heavier for children or elderly people who would like to use the instrument.

While the prior art achieve their objectives, they do not disclose any of the elements of the present invention, and do not provide a tambourine shoe with jingles, bells, clacker, clapper, metal shakers or removable tap shoe soles which can be fixed onto both feet of a user.

SUMMARY OF THE INVENTION

In view of the disadvantages known in the prior art, the present invention provides a new foot operated percussion shoe that is capable of attaching and detaching accessory instruments with clips, Velcro, and magnets. The foot operated percussion shoe's hit stick (spoke) also strikes foot level cowbells, gyros, and cymbals, making it a truly unique foot operated drumstick.

The object of the present invention is a tambourine and spoke fixed onto a shoe such that the tambourine can be played by the foot to create rhythm and the spoke can tap a cymbal, a gyro or cowbells with the feet. The present invention generally comprises of shoes for both feet or single feet coupled with tambourine with a metal stick at the toe part of the shoes.

The other object of the present invention is to secure the shoe onto the users foot. There is no need of any extra straps or buckles or connections. This device is light and can be used by children or by elderly. The other object of present invention is to remove complicated connections or coupling mechanism for connecting to the user's feet to a tambourine. It is further object of present invention that the foot operated tambourine, cymbal, gyro; cowbell playing device can be made of light metal or durable plastic. It is another object of present invention to provide a new foot operated tambourine, gyro, cymbals and cowbell operating device by foot which is very economical and easy to manufacture with universal appeal from all ages, children, young or elderly population. Another object of the present invention is to provide a device such that a tambourine can be played with one foot and a percussion instrument with another foot using spoke. Another object of present invention is to combine bells, metal jingles and shakes with a tambourine to create unique sounds.

BRIEF DESCRIPTION OF THE DRAWINGS

In the figures, which illustrate, by way of example only, embodiments of the present invention.

DETAILED DESCRIPTION OF THE INVENTION

Figure 1:
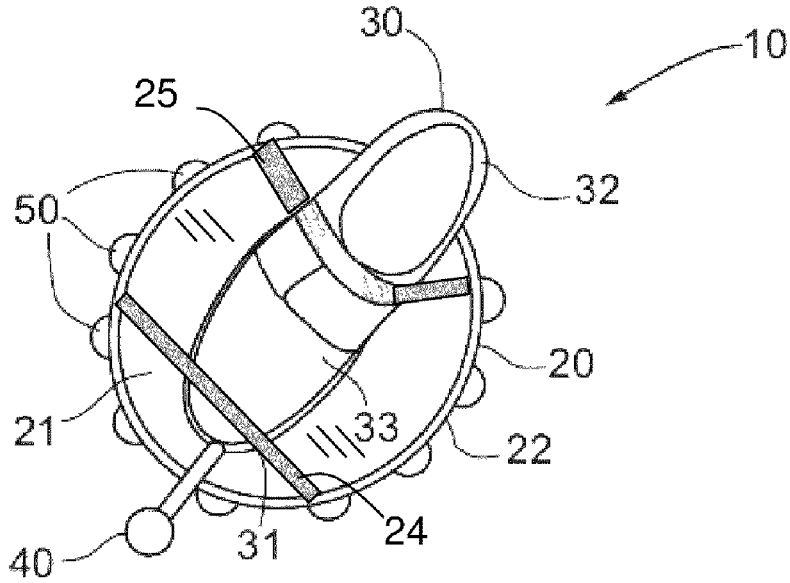
FIG. 1 illustrates a perspective view of the tambourine shoe with a spoke.
Figure 2:
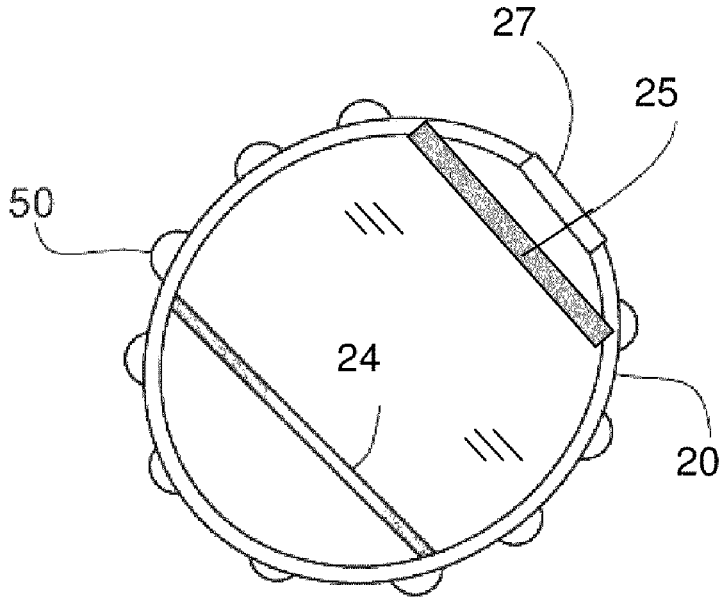
FIG. 2 represents a tambourine with an elastic fastener and an opening to receive a shoe.

FIGS. 1 and 2 Illustrate one embodiment of the foot operated instrument 10. FIG. 1 represents a shoe with a tambourine attached to its bottom, two straps 24 and 25 to go over the top cover of the shoe 33, and a spoke 40, attached to its toe 31.

This instrument comprising, a tambourine 20, having straps 24 and 25 or other means to tightly attach the tambourine to a shoe. Tambourine 20 has two different sounding parts, the head 21 and the jingles 50. Standard tambourines are substantially circular and are made of wood or plastic. The head 21 is of medium thickness skin, parchment or the like as one finds on a drum. The head is stretched tightly over a shell 22, which is made of a hard material, like wood or hard plastic. The elastic straps can go around a shoe and fastened the tambourine to a shoe. Straps are attached to the shell on both sides and can either be elastic or Velcro type straps. Standard tambourine size is about ten inches in diameter with a double row of jingles 50 (preferably staggered). The shell should be lightweight to allow easy movement and to permit an acceptable vibration. The jingle discs 50 are typically made of metal and are freely mounted on pins (not shown) so as to produce jingling sounds when the tambourine is shaken. The shell 20 has a section 27 which is either fully open or has a smaller height than the rest of the shell.

Figure 3:
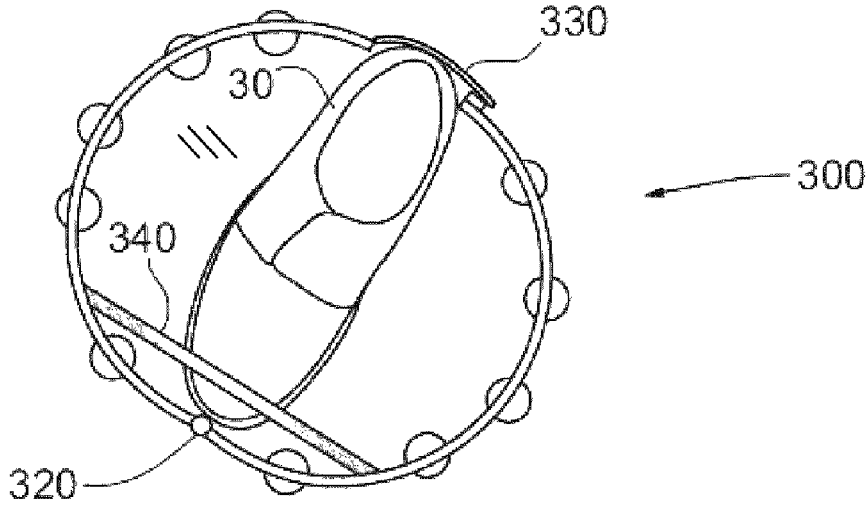
FIG. 3 represents a tambourine with clamping mechanism.

FIG. 3 illustrates a different embodiment of the same invention having a tambourine with a fastener, which goes behind the shoe. Tambourine 300 has hinges 320 that allow it to open. A shoe 30 is then fit inside the tambourine. The tambourine is then closed and tightened to the shoe. A belt buckle 330, or similar connectors, can be used to tighten the tambourine to the shoe. The shoe is then secured from the back to the tambourine. Other securing means, such as an elastic band, 340, is also located in the front part of the tambourine to secure the front of the shoe to the tambourine.

Figure 4:
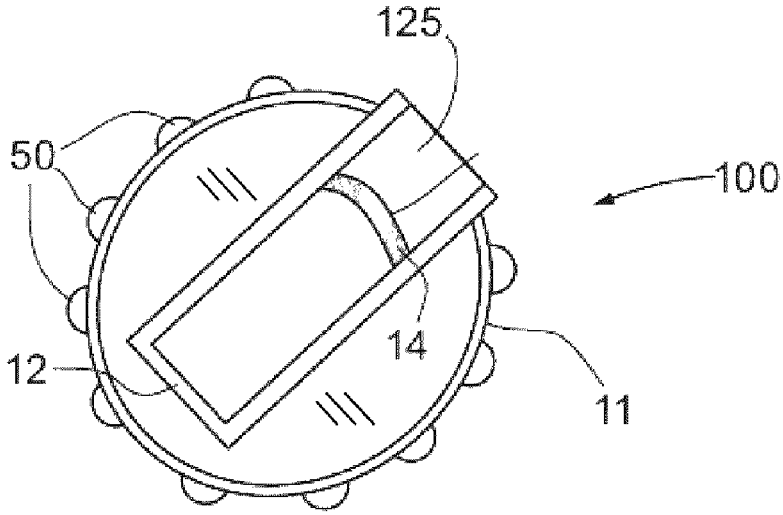
FIG. 4 illustrates a tambourine attached to a frame that users foot can easily fit into, with shoes or barefoot; the unique frame adjusts to the users foot when tightened.

Another embodiment of the present invention is illustrated in FIG. 4, wherein tambourine 100 has a special frame. The frame comprises of a circular outer shell 11 and a rectangular inner shell 12. The jingles 50 are attached to the circular outer shell. The rectangular inner shell 12 is designed to receive a shoe in its opening 125. A connecting device 14, such as Velcro, laces, buckles, or other mechanisms, is used to tightly fix a shoe to the tambourine. A shoe is positioned inside the inner shell 12 and tightened.

Figure 5A:
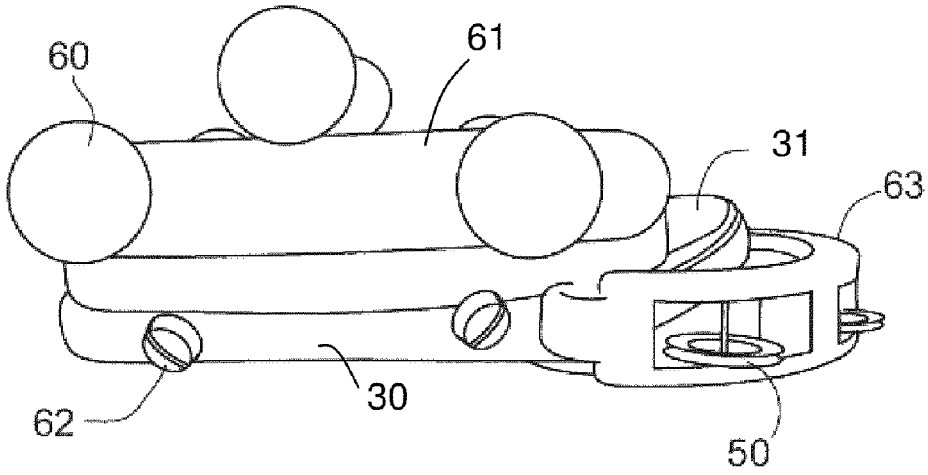
FIG. 5*a* represents lateral view of foot shake tambourine.
Figure 5B:
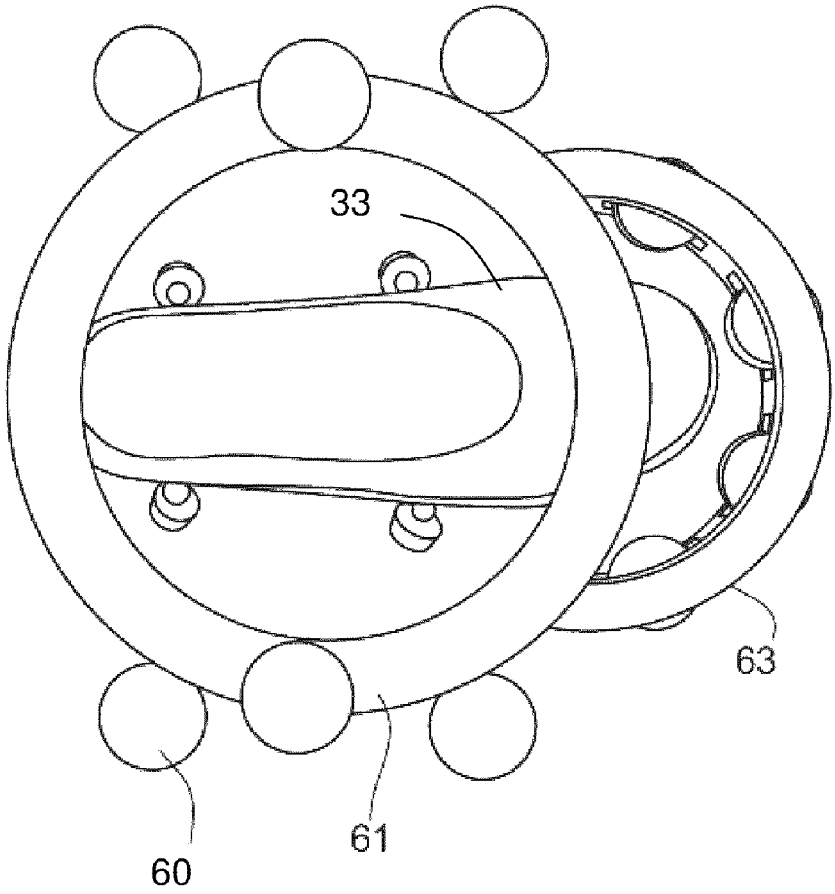
FIG. 5*b* represents aerial view of foot shake tambourine.

FIGS. 5*a* and 5*b* illustrate side and top views of a foot tambourine, which comprises of a half tambourine 63, with jingles 50 attached to the toe part 31 of a shoe. Plastic or metal circular disc 61 covering the full diameter of the upper part of the shoe 30 is attached to the upper cover 33. Shakes 60 are clipped onto the plastic or metal disc 61 by any mechanism known in prior art. Bells 62 are attached across the shoe 30.

Figure 6:
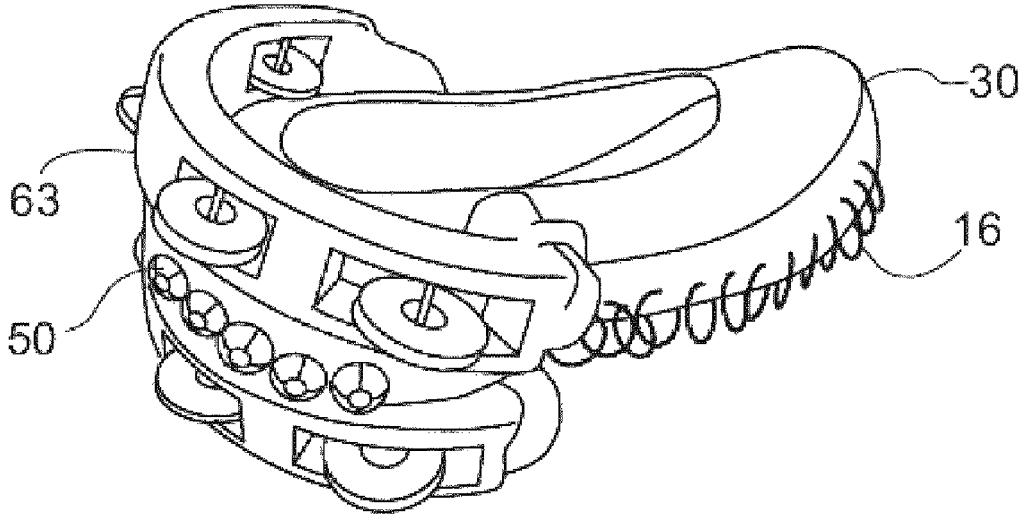
FIG. 6 represents a percussion foot shake tambourine shoe with Djembe shakers on the sole.

Half tambourine can be attached to the back of a shoe as illustrated in FIG. 6. Half tambourine 63 is attached at the rear end of the shoe along with bells 50. Djembe shakers 16 are also fixed onto the shoe 30. When the shoe is moved they give a special sound.

Figure 7:
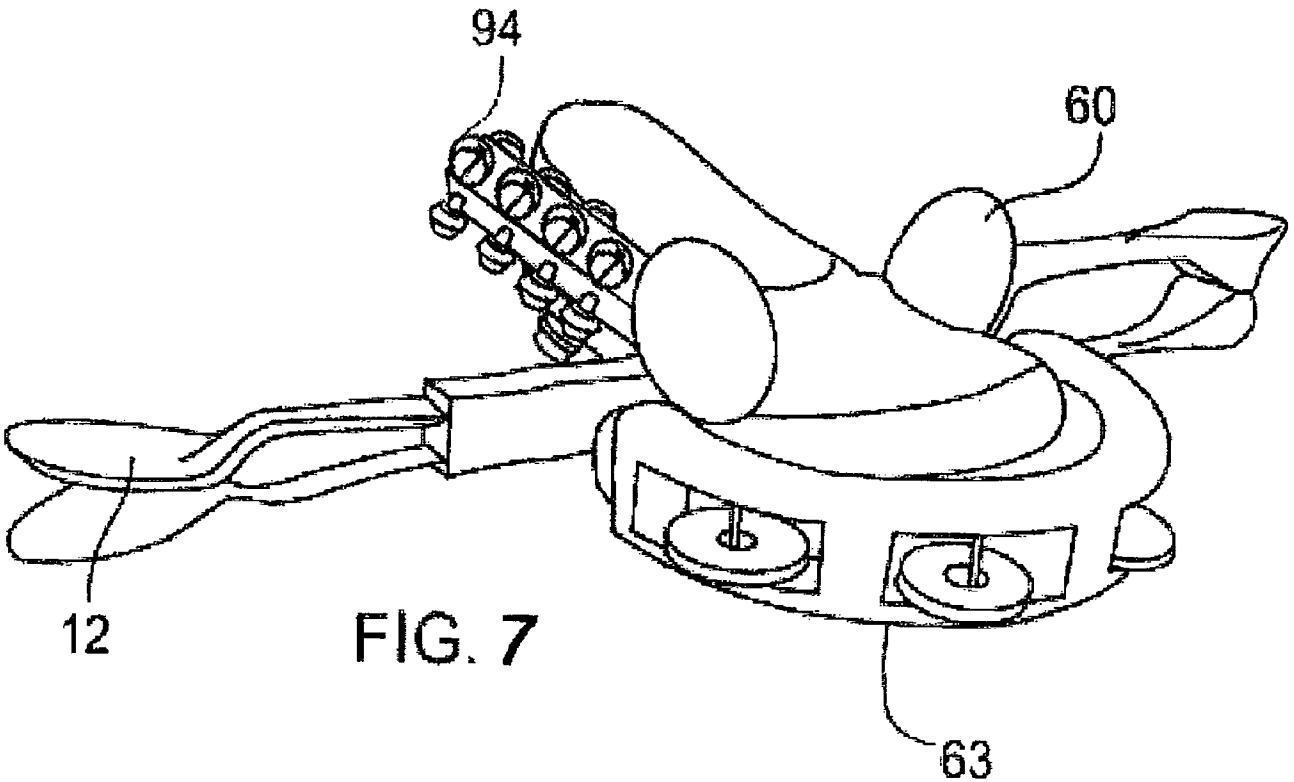
FIG. 7 represents a view of Jingle Spoon Shoe.

FIG. 7 represents a view of jingle spoon shoe, where half tambourine 63 is attached to the forward end of the shoe and jingles 94 attached to the rear end of the shoe. Spoons 12 attached to the centre of the said shoe. The shoe may also have shakers 60. In operation, the tambourine is worn as/with a shoe. As the shoe is tapped the jingles and additional instruments attached to the shoe make a sound.

Figure 8A:
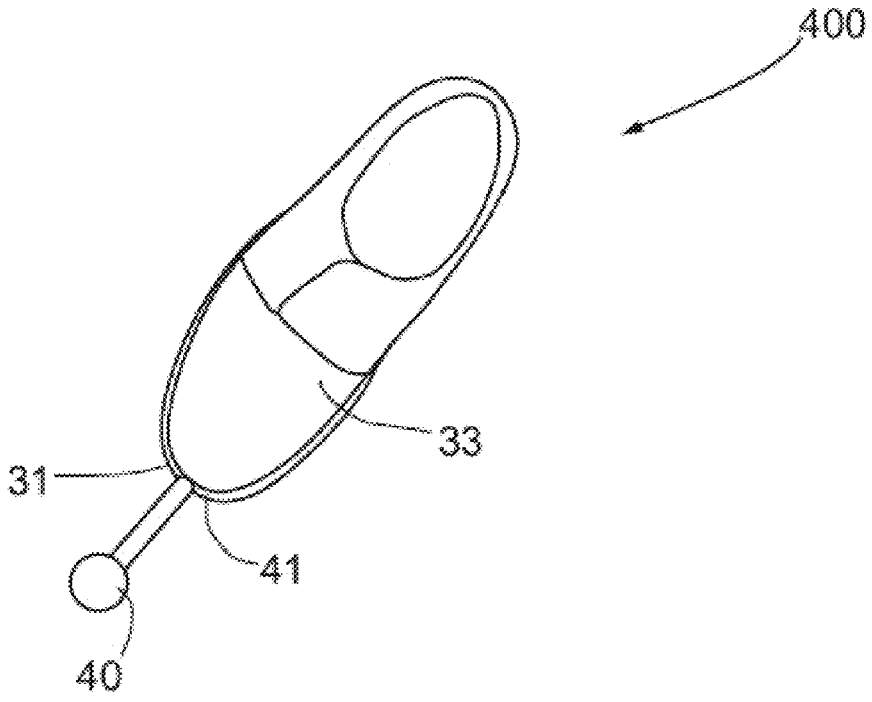
FIG. 8 represents a percussion shoe with a spoke.
Figure 8B:
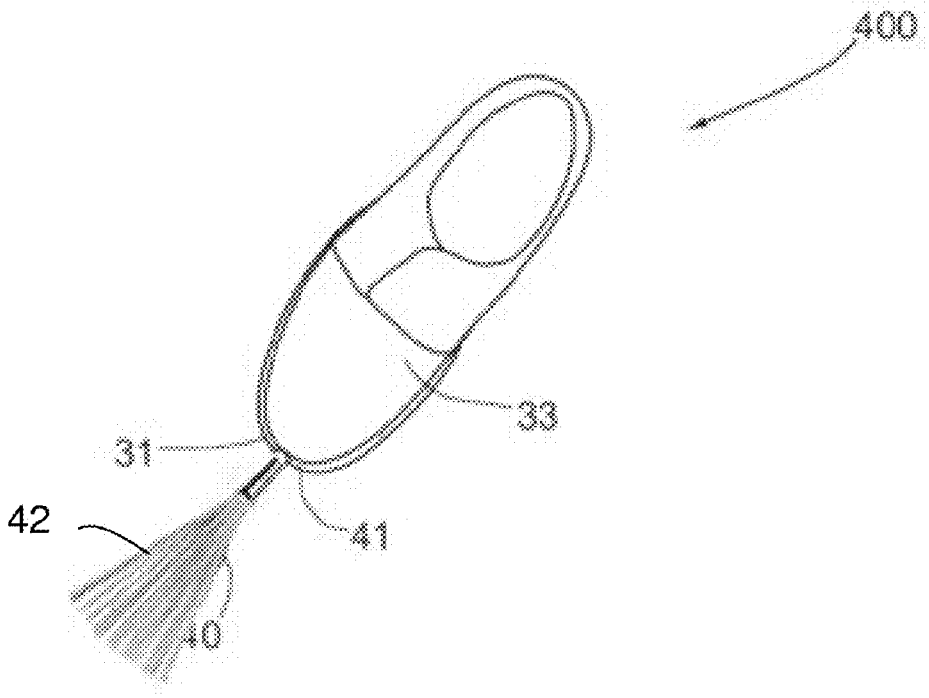
Figure 9:
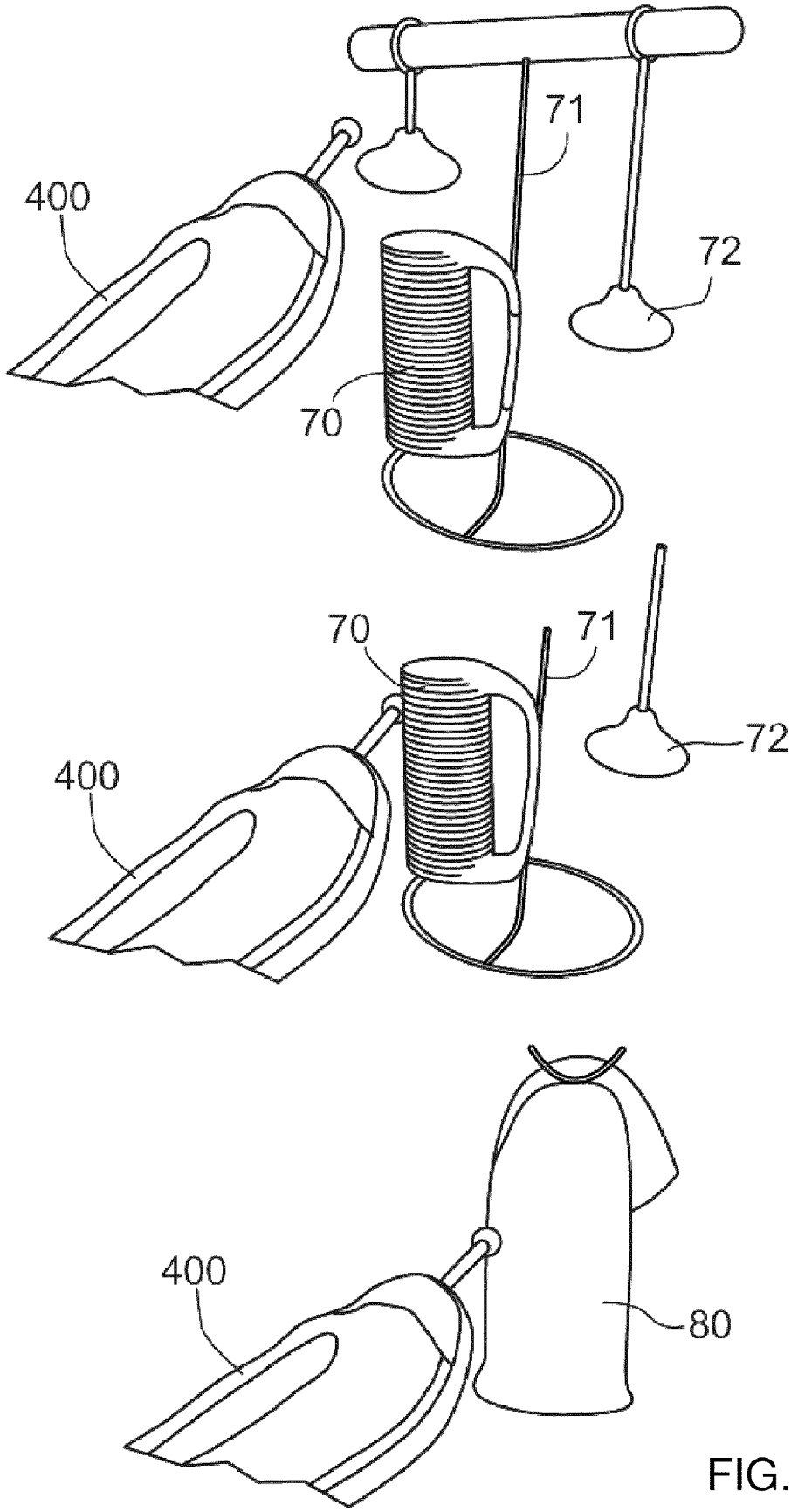
FIG. 9 represents the method of operation of a percussion shoe with spoke; modified gyros, cowbells and cymbals can be played.

FIG. 8*a* illustrates a percussion shoe 400. This shoe has a spoke 40 connected at the toe end 31 of the toe cover 33. The spoke can be made of metal, plastic, wood, fiberglass, or the like. Spoke 40 is a longitudinal stick which has a ball shaped forward end 41, which is connected to the toe cover 33. FIG. 8*b* illustrates the same percussion shoe with a spoke further having a drum brush 42. The brush can be made of metal or plastic and it may be clipped onto the stem of the spoke 40. FIG. 9 illustrates the method of use of the shoe with a spoke. The percussion shoe 400, can be used to strike a guiro 70 or cymbals 72 or cowbells 80, which may be mounted on a frame 71 to be located on the ground.

Figure 10:
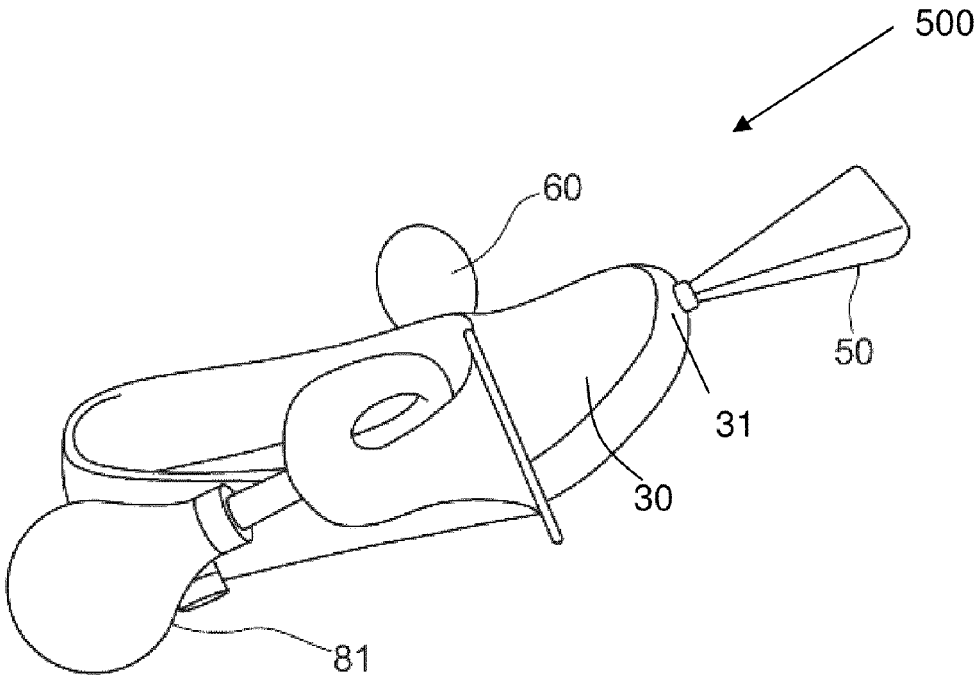
FIG. 10 represents a percussion shoe with shakers, bells and a horn.

FIG. 10 illustrates another embodiment of the present invention of a percussion shoe with toe bells. Toe bell shoe 500 comprises of a bell 50 attached to part 31 of the shoe 30. The bell 50 can be attached to the toe part 31 by any mechanism known in prior art. The bell 50 has a metal oscillator inside it. When the shoe is tapped on to the floor, sound of ringing bell can be heard. A horn 81 and shakes 60 are clipped on to the side of the shoe 30. This horn can be played by the other foot or by hand during a performance. The horn can be attached to the shoe by any methods known in the prior art.

Figure 11:
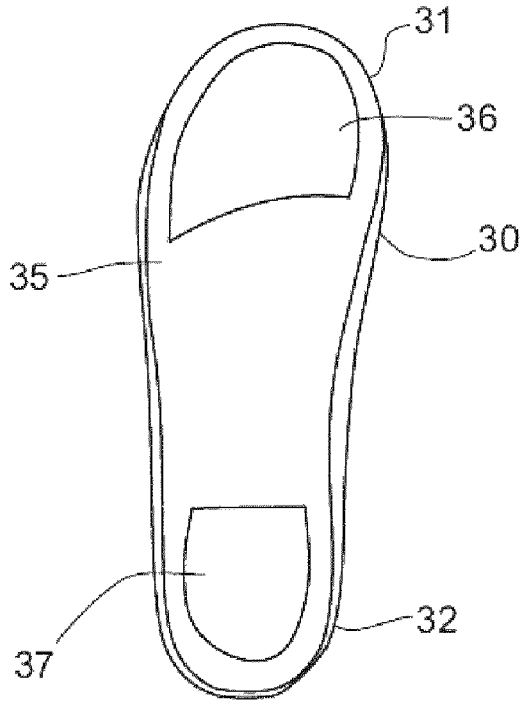
FIG. 11 represents the bottom of the shoe with magnetic and Velcro grooves to attach additional instruments designed for the shoe.

FIG. 11 illustrates the bottom 35 of the shoe 30. The bottom of the shoe 35 has two connecting means: one at a forward end 36 under the toe part 31, and the other at the rear part 37 under the heel part. These two connecting means are designed to fasten shoe accessories and they can be Magnetic or Velcro strips or clips.

Figure 12:
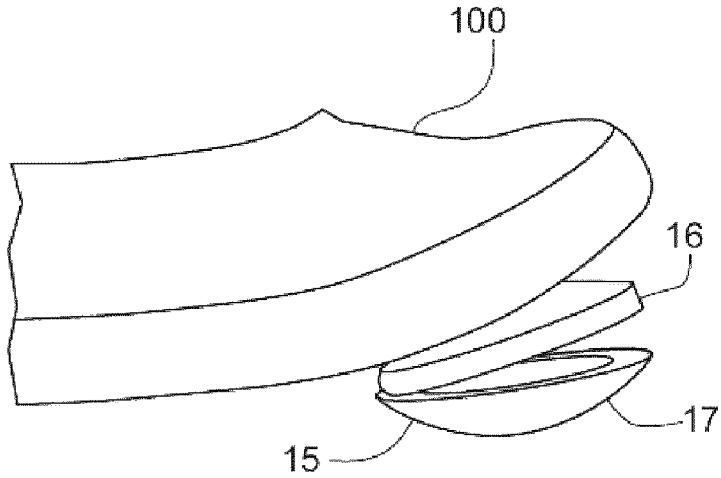
FIG. 12 represents a clap shoe.

FIG. 12 illustrates a sole clap shoe 100, which combines the shoe 30 with a metal clap 15. A plastic or metal clap 15 is attached to the bottom of the sole 36 of the shoe which has a magnetic strip on its toe end 36 and heel end 37. Metal clap 15 consists of an upper end 16 and a lower end 17. The metal clap 15 can be made of iron or steel.

Figure 13:
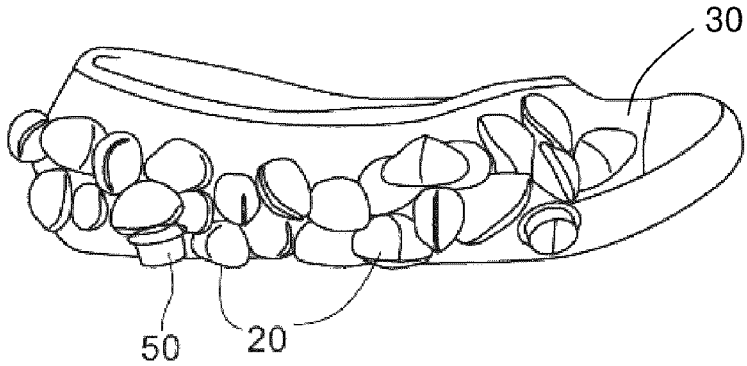
FIG. 13 represents a shoe with sea shells or hollow wooden shells.

FIG. 13 represents another embodiment of present invention, which comprises of shoe 30, shell shakers 20 along with bells 50 are attached across the shoe 30 by any of the mechanisms known in prior art. When the shoe hits the ground percussion sound can be heard.

Figure 14:
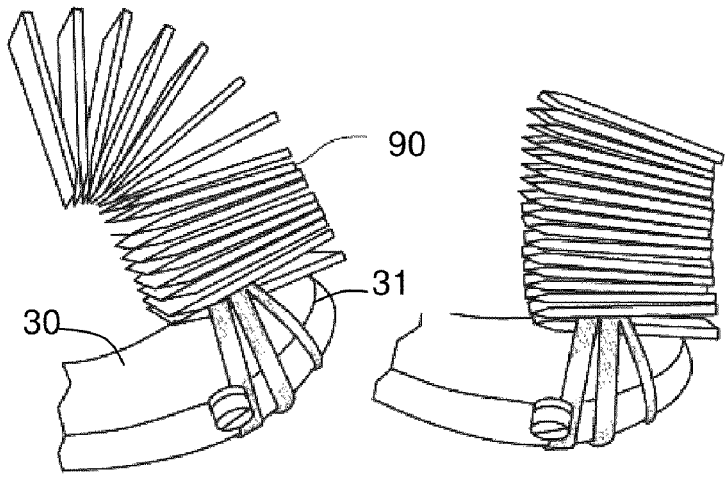
FIG. 14 represents a percussion shoe with wooden clackers.

FIG. 14 represents another embodiment of present invention, where wooden clackers 90 are arranged to the toe part 31 of the shoe 30 by any of the mechanisms known in prior art. When the shoe is moved up and down the clackers move up and down to generate a particular sound.

Since many modifications, variations and changes in detail may be made to the presently described embodiment, it is intended that all matters in the foregoing description and accompanying drawings be interpreted as illustrative and not by way of limitation.

The invention claimed is:

1. A foot operated percussion instrument, comprising:

a. a shoe;

b. a substantially circular outer shell having an inner open space;

c. said shell having slots around its body to receive jingles;

d. a skin or a parchment or a similar material stretched over one side of the shell forming the head of a tambourine;

e. multiplicity of straps, elastic bands, Velcro straps, nylon strap with a plastic tightening device or shoe receiving pockets extending across the shell; and f. said shoe located on the head of the tambourine and the tambourine fixed to the shoe using the straps.

2. A foot operated percussion instrument of claim 1, further comprising a substantially rectangular inner shell; said inner shell designed to receive a shoe or a foot; a section of the outer shell being in common with one of the shorter sides of the inner rectangular shell; a skin or a parchment or a similar material stretched from the outer shell to the inner shell forming the head of a tambourine; and said inner shell having means to tightly receive a shoe or a foot.

3. A foot operated percussion instrument of claim 1, wherein said shell has a hinge and a buckle, whereby the shell can be opened to allow the shoe to easily locate inside the tambourine and be closed and tightened using the buckle.

4. A foot operated percussion instrument of claim 1, wherein said shell comprising of two substantially semicircular shells; each said semicircular shell connected to one side of the shoe; and said head stretching across the two shells and over the shoe.

5. A musical percussion shoe according to claim 1, wherein said shoe with tambourine comprising: a first frame and a second frame, said frames having longitudinal slots to mount jingles, each said frame having a first end and a second end, said first and second frames are connected to each other at their first end using a hinge mechanism, said first and second frames are long enough to form an opening at their second ends when the two frames are in closed position, whereby, said frames can be folded to open the tambourine to allow a shoe to enter inside the inner part of the tambourine.

6. A foot operated percussion instrument of claim 1, wherein said shoe further comprising a spoke attached onto the toe of the shoe, whereby the spoke can be used to play a guiro, cymbals, or cowbells.

7. A foot operated percussion instrument of claim 1, wherein said shoe further comprising a bell attached onto the toe of the shoe; a horn attached on one side of the shoe and shakes clipped attached onto the second side of the shoe.

8. A foot operated percussion instrument of claim 1, wherein said shoe further comprising multiplicity of magnetic strips on the sole of the shoe; a metal, plastic, or wood clap attached to the bottom of the sole of the shoe which has a magnetic strap at ends, whereby the claps can be played by moving the shoe.

9. A foot operated percussion instrument of claim 1, wherein said shell is substantially semicircle having jingles forming a half tambourine, said shoe attached to said half tambourine.

10. A foot operated percussion instrument of claim 1, wherein said shoe further comprising a Djembe shakers fixed onto the magnetic strap of the upper toe part of the shoe; half tambourine attached at the rear end of the shoe along with bells; Djembe shakers can be fixed on the magnetic strip at the rear end of the shoe.

11. A foot operated percussion instrument of claim 1, further comprising shell shakers along with bells attached across the shoe.

12. A foot operated percussion instrument of claim 1, further comprising: wooden clackers arranged to the toe part of the shoe.

* * * * *